US008414080B2

(12) United States Patent
Wang

(10) Patent No.: US 8,414,080 B2
(45) Date of Patent: Apr. 9, 2013

(54) FLEXIBLE BAMBOO CHAIR

(76) Inventor: Wen-Tsan Wang, Taipei (TW)

( * ) Notice: Subject to any disclaimer, the term of this patent is extended or adjusted under 35 U.S.C. 154(b) by 292 days.

(21) Appl. No.: 12/910,869

(22) Filed: Oct. 25, 2010

(65) Prior Publication Data

US 2012/0098321 A1 Apr. 26, 2012

(51) Int. Cl.
*A47C 7/02* (2006.01)

(52) U.S. Cl.
USPC ..... 297/452.63; 297/451.3

(58) Field of Classification Search ..... 297/451.8, 297/452.63, 450.1, 451.7, 451.3, 452.1
See application file for complete search history.

(56) References Cited

U.S. PATENT DOCUMENTS

| | | | | |
|---|---|---|---|---|
| 4,049,315 | A * | 9/1977 | Jacobson | 297/451.7 |
| D332,530 | S * | 1/1993 | Nguyen | D6/370 |
| 5,284,380 | A * | 2/1994 | Gehry | 297/451.9 |
| 8,147,002 | B2 * | 4/2012 | Chen et al. | 297/452.63 |
| 8,256,845 | B2 * | 9/2012 | Wang | 297/446.1 |
| 2009/0140568 | A1 * | 6/2009 | Chan et al. | 297/452.11 |

* cited by examiner

*Primary Examiner* — Sarah B McPartlin
(74) *Attorney, Agent, or Firm* — Leong C. Lei

(57) ABSTRACT

A flexible bamboo chair includes outer and inner bamboo strips of two different sizes in an inverted U-shape respectively arranged in parallel at outer and inner sides, a buffer space defined between the outer bamboo strips and the inner bamboo strips, and first and second reinforcing bars bilaterally fixedly mounted in between the outer and inner bamboo strips in the buffer space at different elevations.

2 Claims, 5 Drawing Sheets

FLEXIBLE BAMBOO CHAIR

BACKGROUND OF THE INVENTION a) Field of the Invention

The present invention relates to furniture and more particularly, to a flexible bamboo chair, which is made of curved bamboo strips in a human-body friendly design.

b) Description of the Prior Art

Many different materials, such as wood, plastics, metal, leather and etc. may be used for making different types of chairs. Except the function for use by one person to sit on, a delicate chair can also be used as a decoration item. Bamboo and wood chairs are highly invited by consumers for the advantage of antique beauty.

Chairs, made of any material, commonly have a base unit for positioning on the floor, a seat unit for the sitting of a person, and a support unit that support the seat unit on the base unit. Commercial bamboo chairs are commonly made of bamboo strips by weaving. These commercial bamboo chairs are less flexible, not comfortable for long sitting.

SUMMARY OF THE INVENTION

The present invention has been accomplished under the circumstances in view. It is one object of the present invention to provide a flexible bamboo chair, which is a human-body friendly design comfortable for long sitting.

According to the technical features of the present invention, inverted U-shaped outer bamboo strips and inner bamboo strips of two different sizes are arranged in parallel and fastened with reinforcing bars to provide a human-body friendly seat design that is flexible to buffer the pressure of a person sitting thereon, giving comfort to the user.

In one embodiment of the present invention, the flexible bamboo chair comprises a plurality of outer bamboo strips made in a substantially inverted U-shape and arranged in parallel, each outer bamboo strip having two vertical end portions and a horizontal middle portion connected between the two vertical end portions at a top side, the horizontal middle portion of each outer bamboo strips curving smoothly inwards from two distal ends toward the mid point thereof; a plurality of inner bamboo strips configured subject to the configuration of the outer bamboo strips in a relatively smaller size relative to the outer bamboo strips, the inner bamboo strips being arranged in parallel at an inner side relative to the outer bamboo strips; a buffer space defined between the outer bamboo strips and the inner bamboo strips; a plurality of first reinforcing bars bilaterally fixedly mounted in between the outer bamboo strips and the inner bamboo strips in the buffer space at an upper side near the horizontal middle portions of the outer bamboo strips; and a plurality of second reinforcing bars bilaterally fixedly mounted in between the outer bamboo strips and the inner bamboo strips at a bottom side adjacent to the two distal ends of each of the outer bamboo strips and the inner bamboo strips.

In another embodiment of the present invention, the flexible bamboo chair further comprises a seat back. The seat back comprises a plurality of smoothly arched vertical bamboo bars respectively fastened to the inner bamboo strips and arranged in a parallel manner, and a headpiece transversely mounted on the smoothly arched vertical bamboo bars at a top side remote from the inner bamboo strips and the outer bamboo strips.

In still another embodiment of the present invention, the flexible bamboo chair further comprises two open spaces respectively formed in two opposite lateral sides, and two third reinforcing bars respectively mounted in the buffer space around the open space. Each third reinforcing bar has one end thereof backwardly extending out of the outer bamboo strips and the inner bamboo strips and terminating in a rear leg and the opposite end thereof forwardly extending out of the outer bamboo strips and the inner bamboo strips and terminating in a front leg.

DETAILED DESCRIPTION OF THE PREFERRED EMBODIMENT

Figure 1:
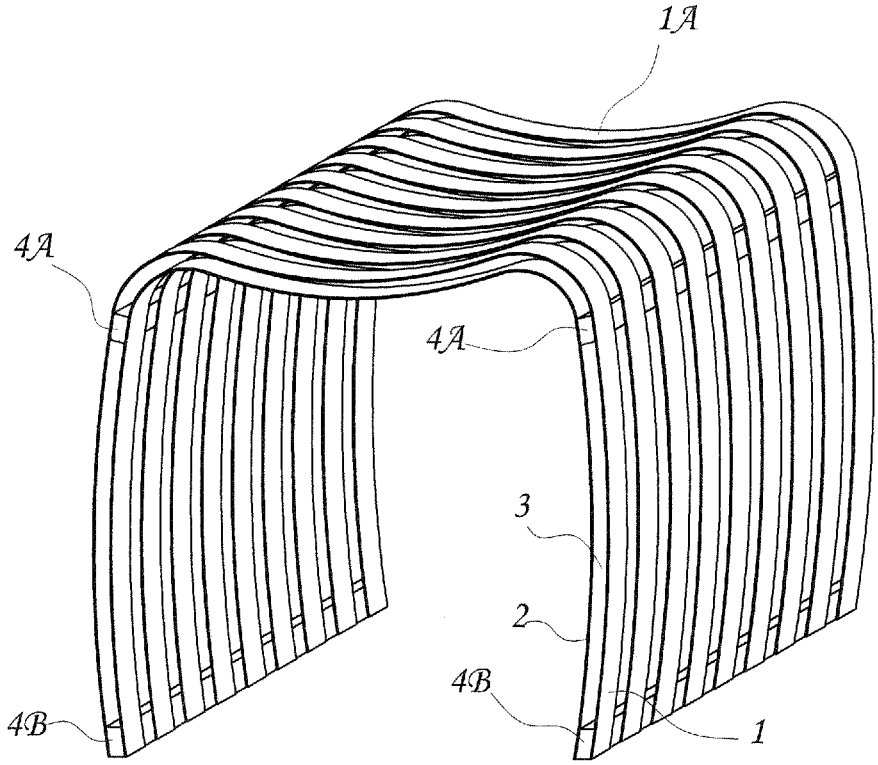
FIG. 1 is an elevation of a flexible bamboo chair in accordance with a first embodiment of the present invention.
Figure 2:
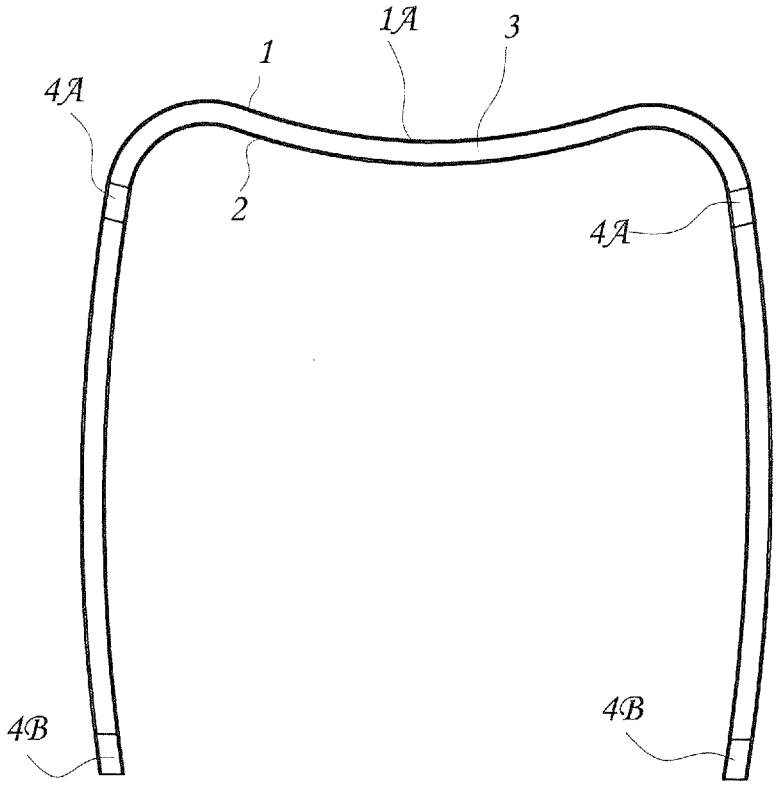
FIG. 2 is a plain end view of the flexible bamboo chair in accordance with the first embodiment of the present invention.
Figure 3:
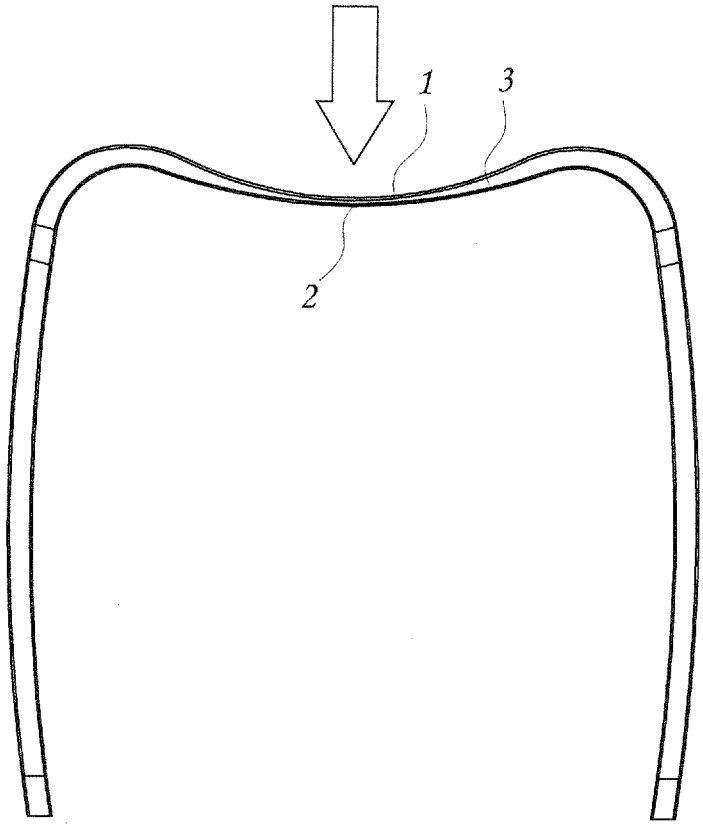
FIG. 3 is a schematic drawing of the first embodiment of the present invention, illustrating the pressure-buffering effect of the chair upon a vertical pressure.

Referring to FIGS. 1 and 2, a flexible bamboo chair in accordance with a first embodiment of the present invention is shown comprising a plurality of outer bamboo strips 1, a plurality of inner bamboo strips 2, and a plurality of first and second reinforcing bars 4A;4B. The outer bamboo strips 1 and the inner bamboo strips 2 are respectively made in a substantially inverted U-shape, each having two vertical end portions and a horizontal middle portion connected between the two vertical end portions at the top. The horizontal middle portion, referenced by 1A, of each outer bamboo strips 1 smoothly curves inwards from the two distal ends toward the mid point thereof The inner bamboo strips 2 are configured subject to the configuration of the outer bamboo strips 1, however, the size of the inner bamboo strips 2 is relatively smaller than the size of the outer bamboo strips 1. The outer bamboo strips 1 are arranged in parallel, so that the horizontal middle portions 1A of the outer bamboo strips 1 serves as a seat for the sitting of a person. The inner bamboo strips 2 are arranged in parallel and disposed at an inner side relative to the outer bamboo strips 1. The first and second reinforcing bars 4A;4B are mounted in between the outer bamboo strips 1 and the inner bamboo strips 2 at different elevations so that a buffer space 3 is defined between the outer bamboo strips 1 and the inner bamboo strips 2. The first reinforcing bars 4A are bilaterally mounted in between the outer bamboo strips 1 and the inner bamboo strips 2 at an upper side near the horizontal middle portions 1A of the outer bamboo strips 1. The second reinforcing bars 4B are bilaterally mounted in between the outer bamboo strips 1 and the inner bamboo strips 2 in blush with the two distal ends of each of the outer bamboo strips 1 and inner bamboo strips 2. Further, the first and second reinforcing bars 4A;4B can be fastened to the outer bamboo strips 1 and the inner bamboo strips 2 by an adhesive, nails, or mortise joints. As the first reinforcing bars 4A are bilaterally mounted in between the outer bamboo strips 1 and the inner bamboo strips 2 at an upper side near the horizontal middle portions 1A of the outer bamboo strips 1, the buffer space 3 between the outer bamboo strips 1 and the inner bamboo strips 2 corresponding to the horizontal middle portions 1A of the outer bamboo strips 1 forms a flexible space for allowing the seat formed of the horizontal middle portions 1A of the outer bamboo strips 1 to be flexibly vertically moved to absorb shocks when a person sits thereon.

As the horizontal middle portions 1A of the outer bamboo strip 1 are curved smoothly inwards from the two distal ends toward the mid point thereof, the seat that is formed of the horizontal middle portions 1A of the outer bamboo strips 1 fits the curvature of the hips of a person for comfortable sitting. Further, when a person sits on the seat that is formed of the horizontal middle portions 1A of the outer bamboo strips 1, the buffer space 3 between the outer bamboo strips 1 and the inner bamboo strips 2 corresponding to the horizontal middle portions 1A of the outer bamboo strips 1 buffers the pressure, giving comfort to the person sitting on the seat. Further, when a person sits on the seat, the two vertical end portions of each of the outer bamboo strips 1 and inner bamboo strips 2 also provide a buffer effect to buffer the pressure of the person sitting on the seat. Actually the two vertical end portions of each of the outer bamboo strips 1 and inner bamboo strips 2 are not straight but slightly smoothly arched to provide a better pressure-buffering effect.

Figure 4:
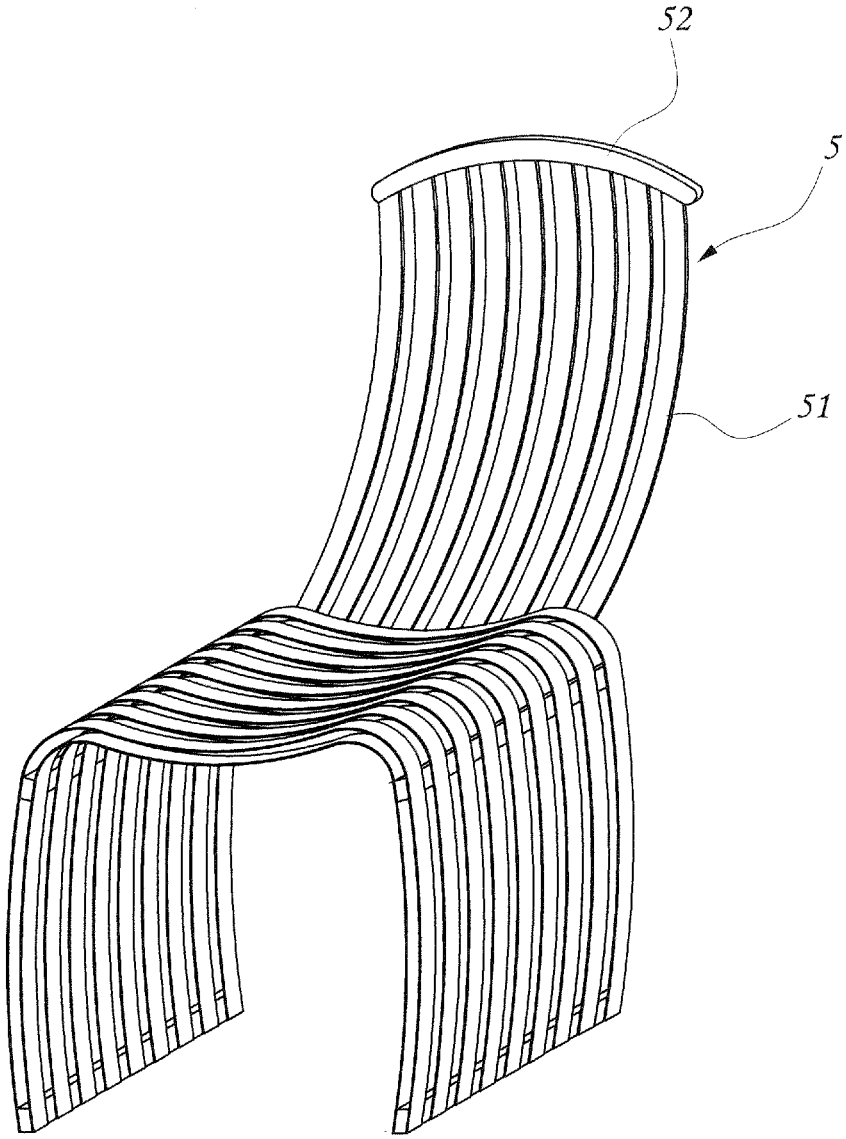
FIG. 4 is an oblique elevation of a flexible bamboo chair in accordance with a second embodiment of the present invention.

FIG. 4 illustrates a flexible bamboo chair in accordance with a second embodiment of the present invention. This second embodiment is substantially similar to the aforesaid first embodiment with the exception of an added seat back 5. The seat back 5 comprises a plurality of smoothly arched vertical bamboo bars 54 respectively fastened to the inner bamboo strips 2 and arranged in a parallel manner, and a headpiece 52 transversely located on the top side of the smoothly arched vertical bamboo bars 54.

Figure 5:
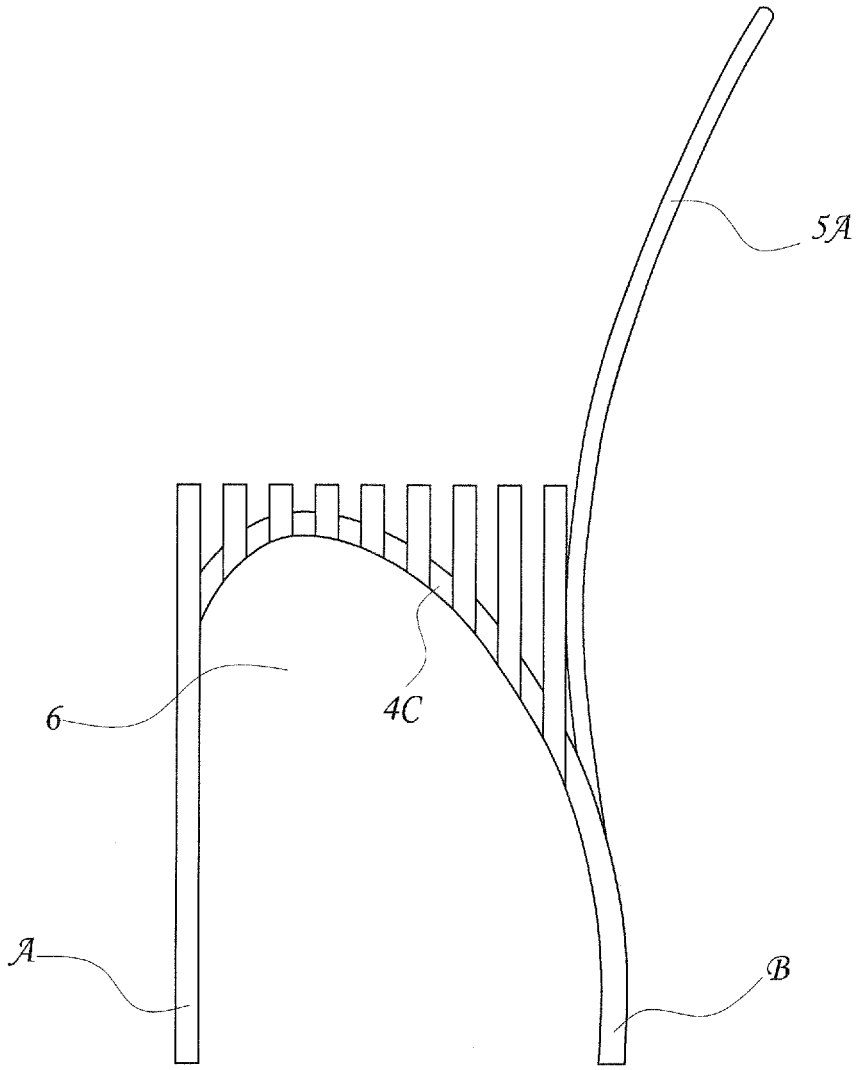
FIG. 5 is a side plain view of the flexible bamboo chair shown in accordance with a third embodiment of the present invention.

FIG. 5 illustrates a flexible bamboo chair in accordance with a third embodiment of the present invention. This third embodiment is based on the aforesaid second embodiment, and characterized in that two open spaces 6 are respectively formed in the two opposite lateral sides thereof, and two third reinforcing bars 4C are respectively mounted in the buffer space (not shown) in the flexible bamboo chair around the two open spaces 6; each third reinforcing bar 4C has one end thereof backwardly extending out of the outer bamboo strips and the inner bamboo strips and terminating in a rear leg B and the other end thereof forwardly extending out of the outer bamboo strips and the inner bamboo strips and terminating in a front leg A; the seat back, referenced by 5, is smoothly arched and upwardly extended from the third reinforcing bars 4C for supporting the back of the user sitting on the flexible bamboo chair.

Although particular embodiments of the invention have been described in detail for purposes of illustration, various modifications and enhancements may be made without departing from the spirit and scope of the invention. Accordingly, the invention is not to be limited except as by the appended claims.

I claim:

1. A flexible bamboo chair, comprising:

a plurality of outer bamboo strips made in an inverted U-shape, each said outer bamboo strip having two vertical end portions and a horizontal middle portion curving smoothly inwards from two distal ends toward the mid point thereof;

a plurality of inner bamboo strips in a relatively smaller size arranged in parallel at an inner side relative to said outer bamboo strips;

a buffer space defined between said outer bamboo strips and said inner bamboo strips;

a plurality of first reinforcing bars fixed in said buffer space at an upper side near the horizontal middle portions of said outer bamboo strips; and a plurality of second reinforcing bars fixed between said outer bamboo strips and said inner bamboo strips at a bottom side adjacent to the two distal ends of each of said outer bamboo strips and said inner bamboo strips.

2. The flexible bamboo chair as claimed in claim 1, further comprising a seat back, said seat back comprising a plurality of smoothly arched vertical bamboo bars respectively fastened to said inner bamboo strips and arranged in a parallel manner, and a headpiece transversely mounted on said smoothly arched vertical bamboo bars at a top side remote from said inner bamboo strips and said outer bamboo strips.

* * * * *